United States Patent [19]

Steiner et al.

[11] 4,193,384

[45] Mar. 18, 1980

[54] FUEL INJECTION SYSTEM

[75] Inventors: Josef Steiner, Esslingen; Friedbert Michel, Kornwestheim, both of Fed. Rep. of Germany

[73] Assignee: Robert Bosch GmbH, Stuttgart, Fed. Rep. of Germany

[21] Appl. No.: 792,737

[22] Filed: May 2, 1977

[30] Foreign Application Priority Data

May 14, 1976 [DE] Fed. Rep. of Germany ..... 2621555

[51] Int. Cl.[2] ..... F02M 1/10

[52] U.S. Cl. ..... 123/179 L; 123/139 ST; 261/50 A

[58] Field of Search ..... 123/139 ST, 179 L, 32 EG, 123/139 AW; 261/50 A, DIG. 74

[56] References Cited

U.S. PATENT DOCUMENTS

| | | | |
|---|---|---|---|
| 2,600,368 | 6/1952 | Winhler | 261/DIG. 74 |
| 2,894,499 | 7/1959 | Dermond | 123/139 ST |
| 3,613,650 | 10/1971 | Stumpp | 123/139 AW |
| 3,664,319 | 5/1972 | Channing | 123/179 L |
| 3,699,941 | 10/1972 | Hughes et al. | 123/179 L |
| 3,871,344 | 3/1975 | Pigeroulet et al. | 123/179 L |
| 3,999,527 | 12/1976 | Wessel et al. | 123/139 AW |
| 4,026,259 | 5/1977 | Meyerdierks et al. | 123/139 AW |

OTHER PUBLICATIONS

Bosch Technical Instruction for CIS Fuel Injection, Germany 2/74, title page and p. 11.

*Primary Examiner*—Charles J. Myhre
*Assistant Examiner*—Andrew M. Dolinar
*Attorney, Agent, or Firm*—Edwin E. Greigg

[57] ABSTRACT

A fuel injection system for continuous fuel injection into the induction manifold of an internal combustion engine. Upstream of the main throttle, there is disposed a baffle plate on a pivoting lever which act as an air flow rate meter and displaces the slide valve of a fuel metering assembly in proportion to the air flow rate. An electromagnetic actuator, attached to the induction tube, has a movable armature on which there is disposed a spring. During engine starting at temperatures below approximately 30 degrees C., the restoring force on the air flow rate meter is so low that the force of the actuator spring is able to displace the pivoting lever and the slide valve in the direction of greater fuel delivery, thereby providing cold starting assistance. In other embodiments, the temperature dependence is increased by using a bimetallic spring on the actuator.In a further embodiment, the actuator is attached to the operating lever.

4 Claims, 5 Drawing Figures

FUEL INJECTION SYSTEM

BACKGROUND OF THE INVENTION

The invention relates to a fuel injection system for mixture compressing externally ignited internal combustion engines which employ continuous fuel injection into the induction tube. In engines of this type, the induction tube contains an air flow rate meter as well as a throttle valve which can be actuated arbitrarily by the operator. A restoring force opposes the force of the air on the air flow rate meter and the air flow rate meter displaces a valve slide within a fuel metering system and thereby meters out fuel in proportion to the air flowing through the induction tube. The restoring force acting on the air flow rate meter is a pressurized fluid, the pressure of which may be changed especially in dependence on temperature by means of a control pressure valve.

It is the purpose of fuel injection systems of this type automatically to provide a favorable fuel-air mixture for all operational states of the engine so as to insure complete fuel combustion and the highest possible power and/or lowest fuel consumption. At the same time, it is desired to reduce as much as possible the generation of toxic exhaust gas constituents. To achieve these various and conflicting purposes, the fuel quantity must be very precisely metered out in accordance with the requirements of each and every engine state.

In known fuel injection systems of this type, the fuel quantity is metered out as nearly as possible in proportion to the air flow rate through the induction tube. The ratio between the metered out fuel and air may be changed by changing the restoring force acting on the air flow rate meter in dependence on operational variables of the engine and by means of at least one control pressure valve.

It is known that when the engine temperatures are lower than approximately 30° C., a reliable engine start is obtained only if additional fuel is provided to the engine. This additional fuel is delivered in known fuel injection systems by means of a starting device which is turned on substantially at the time the engine is started and which consists mainly of an electromagnetic fuel injection valve and a thermal switch that limits the opening time of this valve and/or cuts it off entirely at higher temperatures. The electromagnetic starting valve injects the additional fuel into the induction manifold. The thermal switch either opens or closes the circuit of the valve in dependence on engine temperature. When an engine start takes place at a temperature below approximately 30° C., the cold starting circuitry is interrupted by means of an electrically heated bimetallic contact.

A known cold starting device of this type requires additional expenditure because of the supplementary electromagnetic starting valve and the thermal switch and, in addition, the injection of raw fuel into the induction manifold results in a relatively poor distribution of that fuel to the various cylinders. Furthermore, due to the relatively long time required for the effects of the additional injection to be felt and terminated, the fuel enrichment is substantially greater than actually necessary, resulting in rough idling, a high toxic emission factor and high fuel consumption.

OBJECT AND SUMMARY OF THE INVENTION

It is a principal object of the invention to provide a fuel injection system of the general type described above which requires less construction and does not employ the above-described cold starting device yet provides a reliable cold starting of the engine. This object is attained, according to the invention, by providing that the control slide of the fuel metering assembly is displaced in a controlled manner by the armature of an electromagnet in the direction of greater fuel admission when the engine is started at temperatures lower than approximately 30° C.

A favorable embodiment of the invention provides that, when the engine is started at temperatures lower than 30° C., the armature of the electromagnet places a spring in contact with the operating lever of the air flow rate meter and that this spring is embodied as a compression spring.

In a further advantageous embodiment of the invention this spring is a bimetallic U-shaped spring.

Yet another favorable embodiment of the invention provides that the electromagnetic is attached to the operating lever of the air flow rate meter and that the spring moved by the armature of the electromagnet makes contact with and exerts a force on a correction lever which is interposed between the operating lever and the movable slide of the fuel metering system.

The invention will be better understood as well as further objects and advantages thereof become more apparent from the ensuing detailed description of a preferred embodiment taken in conjunction with the drawing.

DESCRIPTION OF THE PREFERRED EMBODIMENTS

Figure 1:
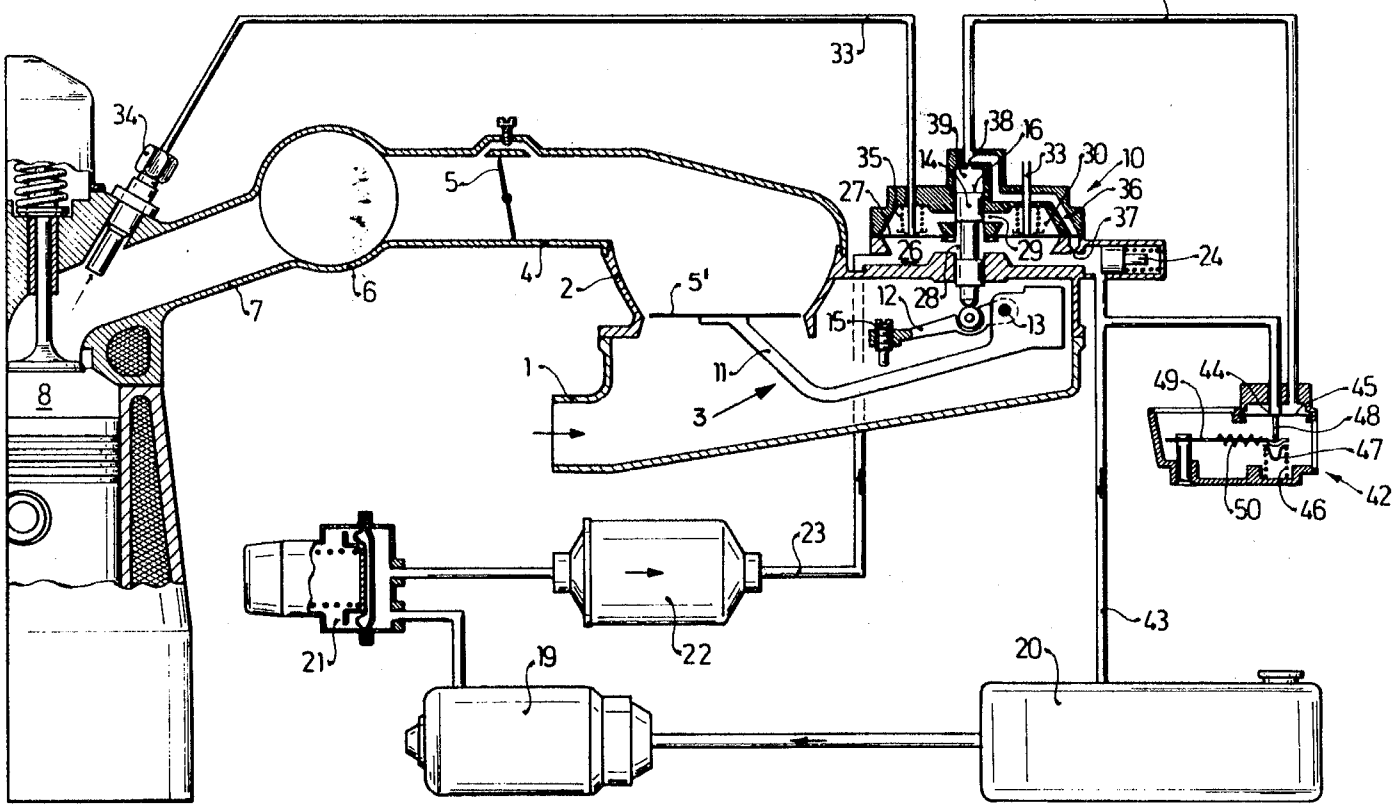
PRIOR ART Fig.1
FIG. 1 is a schematic representation of a fuel injection system of known construction.

Turning now to FIG. 1, there will be seen a fuel injection system including an intake manifold 1 having a conical section 2 which contains a baffle plate 51 of an air flow rate meter 3 beyond which there is located an induction tube region 4 containing an arbitrarily settable throttle valve 5. Intake air flows through the induction tube in the direction of the arrow to a manifold 6 from which it is directed to individual induction tube regions 7 to one or more cylinders 8 of an internal combustion engine.

In the present case, the baffle plate 51 of the air flow rate meter 3 is disposed transversely with respect to the direction of air flow and capable of displacement within the conical region 2 of the induction tube as an approximately linear function of the air flow rate through the tube. The air pressure between the baffle plate 51 and the throttle valve 5 will be constant provided that the restoring force acting on the air flow rate meter 3 is constant and that the air pressure ahead of the baffle 51 is also constant. The air flow rate meter 3 controls the opening of a metering and distribution valve assembly 10. The air flow rate meter 3 also includes a main operating lever 11 and an auxiliary or correction lever 12. The motion of the baffle plate 51 is transmitted by the operating lever 11 which is pivoted on the same shaft 13 as the correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate meter 3 and acts as a return force in opposition to the force of the flowing air.

Fuel is supplied by an electric fuel pump 19 which aspirates fuel from a fuel tank 20 and delivers it through a storage container 21, a filter 22 and a fuel line 23 to the fuel metering and distribution assembly 10. A fuel system pressure controller 24 maintains the system pressure in the fuel injection system constant.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees permitting fuel to flow into chambers 30 which are divided from the chambers 26 by the diaphragm 27. From the chambers 30, fuel flows through the injection channels 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes defined, in each case, by a chamber 26 and a chamber 30, insure that the pressure drop at the metering valve 28, 29 is substantially constant independently of the relative overlap between the annular groove 28 and the control slits 29, i.e., independently of the fuel quantity flowing to the injection valves 34. This insures that the metered out fuel is exactly proportional to the control path of the slide 14.

During a pivoting displacement of the operating lever 11, the baffle plate 51 is moved into the conical region 2 so that the varying annular cross section between the baffle plate 51 and the conical wall remains proportional to the displacement of the baffle plate 51. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end of the control slide 14 extends.

The control pressure line 36 contains a control pressure valve 42 which permits control fluid to return to the fuel tank 20 via a return line 43 without pressure. The control pressure valve 42 permits changing the pressure which produces the restoring force during the warm-up of the engine in dependence on time and temperature. The control pressure valve 42 is a flat seat valve having a fixed valve seat 44 and a diaphragm 45 which is loaded in the closure direction by a spring 46. The spring 46 acts via a spring support 47 and a transmission pin 48 onto the diaphragm 45. When the engine temperature is below the normal operating temperature, a bimetallic spring 49 acts in opposition to the force of the spring 46. The bimetallic spring 49 carries an electric heater, the operation of which causes a diminution of the force of the bimetallic spring 49 on the spring 46, thereby increasing the control pressure in the control pressure line 36.

Figure 2:
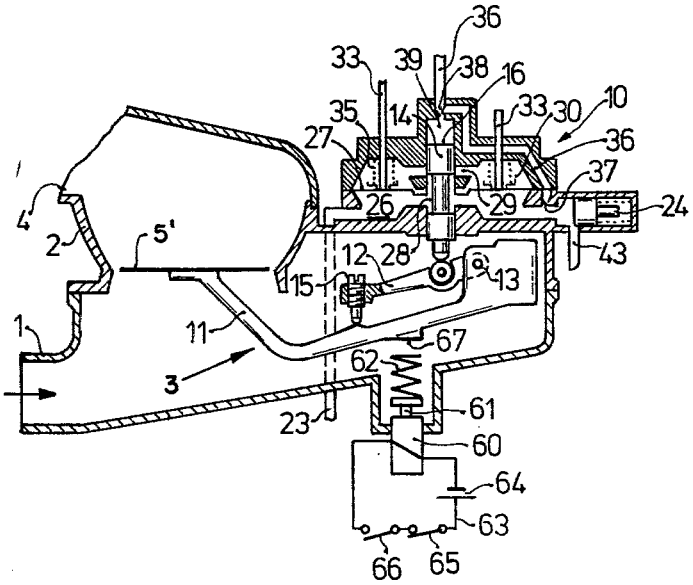
FIG. 2 is an illustration of a first exemplary embodiment of the cold starting device to be used in the fuel injection system of FIG. 1.

Turning now to FIG. 2, there will be seen the first embodiment of a cold starting device according to the invention in which an electromagnet 60 has an armature 61 coupled to a pressure spring 62. The electromagnet 60 is attached firmly to the housing of the induction tube region 1 and its electrical circuit 63 contains a battery 64, an ignition switch 65 and a starting switch 66. When the ignition switch 65 is closed and, subsequently, the starting switch 66 is also closed, the moving armature 61 causes the compression spring 62 to contact a shoulder 67 on the operating lever 11 and displaces the control slide in opposition to the restoring force thereon exerted by the pressurized medium. The direction of motion due to the spring 62 is thus to admit additional fuel during the starting of the engine, i.e., enriching the fuel-air mixture. The dimension of the spring 62 is such that, above temperatures of approximately 30° C., its force is insufficient to displace the control slide 14 in opposition to the restoring force exerted by the pressurized fluid which itself varies as a function of temperature. At low operating temperatures, the control pressure valve 42 causes a lower control pressure in the control line 36 than is present at higher temperatures. Accordingly, for lower temperatures, a reduced restoring force opposes the spring 62, permitting the control slide 14 to be displaced farther in the opening direction than is the case for higher temperatures. Accordingly, for low starting temperatures, the fuel enrichment is greater than when the starting temperature is higher. Once the starting switch is opened, the armature 61 returns to its initial position and the spring 62 is disengaged from the operating lever 11 as illustrated in FIG. 2.

Figure 3:
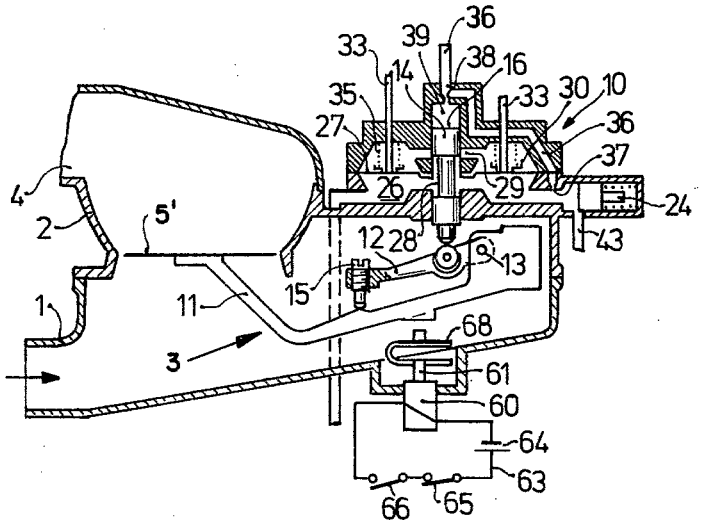
FIG. 3 is an illustration of a second exemplary embodiment of the cold starting device according to the invention.

In a second exemplary embodiment of the cold starting device according to the present invention, illustrated in FIG. 3, the place of the spring 62 is taken by a special U-shaped bimetallic spring 68 also attached to the armature 61. At lower temperatures, the bimetallic spring 68 is bent further in the direction of the operating lever 11, so that, during a cold start at low temperatures, the control slide 14 is displaced further in its opening direction by the action of the electromagnet 60 acting via the spring 68 and the operating lever 11. Thus, a larger quantity of fuel is metered out than when the starting temperature is higher.

The dimensions of the bimetallic spring 68 are so chosen that, when a start takes place above approximately 30° C., the spring 68 makes no contact with the operating lever 11.

Figure 4:
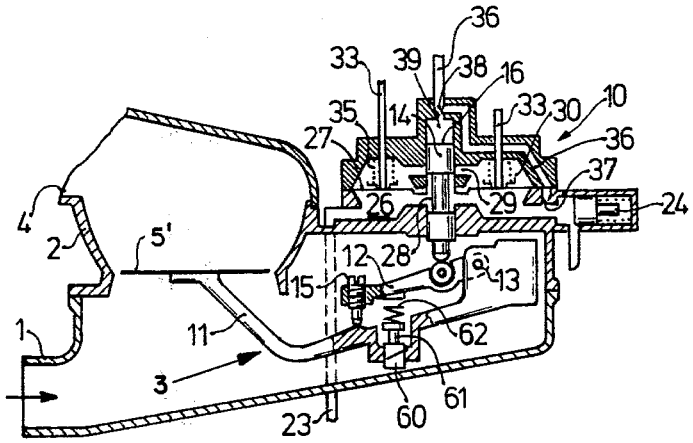
FIG. 4 is an illustration of a third exemplary embodiment of the cold starting device according to the invention.
Figure 5:
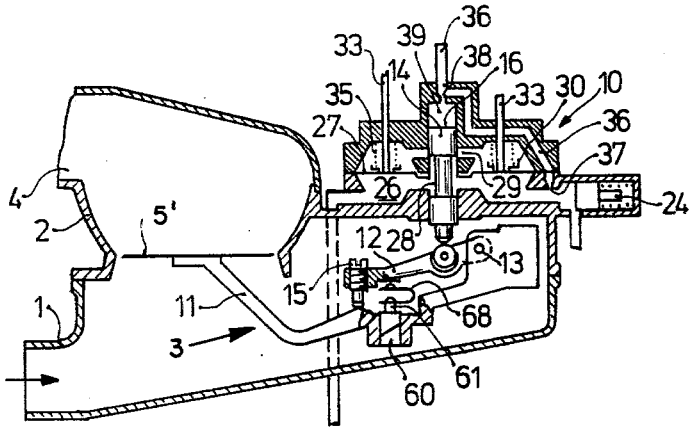
FIG. 5 is a fourth exemplary embodiment of the cold starting device according to the invention.

The exemplary embodiments illustrated in FIGS. 4 and 5 are similar to those illustrated in FIGS. 2 and 3, respectively, except that in both cases, the electromagnet 60 is fixedly attached to the operating lever 11 whereas the compression spring 62 or the bimetallic spring 68 engage the correction lever 12 at starting temperatures lying below approximately 30° C., thereby displacing the control slide 14 in the opening direction. These exemplary embodiments offer the additional advantage that the metered out starting fuel increases during the increasing engine rpm occurring during starting, and the effective fuel enrichment does not decrease as much for higher rpm as is the case in the first and second exemplary embodiments according to FIGS. 2 and 3 so that the engine may achieve higher speeds more rapidly.

The foregoing relates to preferred exemplary embodiments of the invention, it being understood that other embodiments and variants thereof are possible within the spirit and scope of the invention.

What is claimed is:

1. A fuel injection system for an internal combustion engine, said system including: air flow rate meter comprising a main operating lever pivotably disposed in the engine's induction tube, a baffle plate connected at the free end of the main operating lever, which moves in the induction tube under the influence of air flow therein, and an auxiliary operating lever; a fuel metering valve assembly including a slide valve, said slide valve being actuated, in the direction of greater opening of the fuel metering valve assembly, as a result of the displacement of said air flow rate meter, said slide valve being subjected to a return force provided by the pressure of hydraulic fluid; said auxiliary operating lever being pivotably connected to the main operating lever and interposed between the main operating lever and the slide valve; and a pressure control valve for altering the pressure of said hydraulic fluid according to engine temperature, the improvement in said system comprising:

an electromagnetic acutator, attached to said main operating lever, said actuator including a movable armature and a spring secured thereon for displacing said slide valve in the direction of greater opening, said spring being so dimensioned that it displaces said slide valve, during engine starting at temperatures below approximately 30° C., while at temperatures above approximately 30° C. the spring force is insufficient to displace said slide valve.

2. A fuel injection system as defined by claim 1, wherein said spring is a compression spring.

3. A fuel injection system as defined by claim 1, wherein said spring is a bimetallic spring having a temperaturede-pendent shape.

4. A fuel injection system as defined by claim 3, wherein said bemetallic spring is substantially U-shaped, one arm of said U-shape being attached fixedly to said armature.

* * * * *